United States Patent [19]

Stange

[11] 4,218,026

[45] Aug. 19, 1980

[54] PAPER WEB BUFFER SYSTEM

[75] Inventor: Klaus K. Stange, Pittsford, N.Y.

[73] Assignee: Xerox Corporation, Stamford, Conn.

[21] Appl. No.: 918,615

[22] Filed: Jun. 23, 1978

[51] Int. Cl.[2] ..... B65H 23/24

[52] U.S. Cl. ..... 242/55; 226/118; 226/199; 242/182

[58] Field of Search ..... 242/182, 183, 184, 185, 242/75.3, 57, 55; 226/118, 199

[56] References Cited

U.S. PATENT DOCUMENTS

| | | | |
|---|---|---|---|
| 2,968,982 | 1/1961 | Cousino | 83/262 |
| 3,499,614 | 3/1970 | Badum | 242/182 |
| 3,645,470 | 2/1972 | Dickinson et al. | 242/182 |
| 3,807,612 | 4/1974 | Eggert | 226/118 X |
| 3,807,854 | 4/1974 | Tanaka et al. | 355/16 |
| 3,844,551 | 10/1974 | Morrison | 271/99 |
| 3,882,744 | 5/1975 | McCarroll | 83/262 |
| 3,937,421 | 2/1976 | Fender et al. | 242/182 |
| 3,943,530 | 3/1976 | Mourier | 346/136 |
| 4,040,043 | 8/1977 | Stanford | 242/57 |
| 4,050,642 | 9/1977 | Katsumata et al. | 242/182 X |

*Primary Examiner*—John M. Jillions

*Attorney, Agent, or Firm*—Ronald F. Chapuran

[57] ABSTRACT

A buffer system for isolating a supply of paper web from a processor operating on the paper web. The buffer system comprises a vacuum chamber and vacuum pump creating a pressure differential across a portion of the paper web forcing the web into the vacuum chamber in the form of a loop having suitable tension. The loop rises and falls within the vacuum chamber to either store or deliver web to the processor in response to the paper supply delivering more or less web than the processor can accommodate. In one embodiment, the vacuum chamber is provided with a movable wall to accommodate paper webs of different widths and a foot extending from the movable wall communicates with orifices to change the pressure differential.

2 Claims, 5 Drawing Figures

PAPER WEB BUFFER SYSTEM

The present invention relates to a paper handling apparatus and, in particular, to the use of a vacuum buffer in paper web feeding.

It is important in the operation of a printing press to isolate the press from any upsets in paper web tension. Paper tension upsets are caused by unwind break variations, automatic splicer cycles, press speed changes, and changes in paper elasticity and must be absorbed in order to provide close register printing and minimum paper waste. Prior art printing operations generally employ mechanical dancer roll buffers to compensate for tension variations in the paper web. The dancer roll slides within the paper web loop to accommodate changes in tension and is generally a costly and cumbersome device. Mechanical dancer rolls do not allow fast acceleration of the paper web due to the usual dead mass of the roll as well as the friction found in such a system. Dancer rolls also require careful dynamic tuning to allow the web to track properly. In particular, it is often necessary to determine the ratio of the translation mass to the rotating mass of the dancer roll in order that the dancer roll's reluctance to move in its stroke is exactly cancelled by the effect of its reluctance to change rotary speed. A dancer roll system is usually a relatively complex assembly of interrelating mechanical parts. It would, therefore, be desirable to provide a buffer system for effectively absorbing tension variations in a paper web that is simple, economic, reliable, and minimizes the use of mechanical components and interrelated moving parts.

It is known to use vacuum tensioning in magnetic tape and photosensitive film transport systems. U.S. Pat. No. 3,937,412 assigned to the same assignee as the present invention teaches the use of vacuum columns to provide the necessary suction to keep film in contact with capstans and pinch rollers and also the use of a vacuum chamber and a movable shoe to control the contour of the film. U.S. Pat. No. 3,807,854 shows the use of a vacuum system to put a predetermined tension on a photosensitive element disposed between a stock roller and a takeup roller. These disclosures, however, are directed to systems for conveying tapes and films having a relatively small, predetermined width. In addition, to convey tapes and films of significantly difference width, generally separate vacuum chambers would be required. It would, therefore, be desirable to provide a vacuum buffer in a paper web handling system for paper webs having a relatively large width and a vacuum buffer that can be adpated for paper webs of substantially different width.

U.S. Pat. Nos. 2,968,982 and 3,882,744 teach the use of positive air pressure or negative vacuum pressure through perforations in a curved support member to facilitate buckling of paper web and the return of the paper web to a normal posture. The normal posture of the paper is in conformance with the curved support member providing a slight buckle. Additional buckling to absorb the continuously fed paper web is required after the downstream web has been stopped momentarily for cutting or pinching. These systems, however, require the curved support member to preform the paper in its normal curved posture. Preform members add an additional expense and complexity to paper buffer systems. In addition, the positive or negative air pressure is generally not continuous but provided during buckling or unbuckling of the paper. This necessitates further complexity in the system control. It would, therefore, be desirable to provide a paper web buffer system minimizing structural elements and simplifying the control and operation of the system.

Accordingly, it is an object of the present invention to provide a new and improved paper web tension and buffer system.

Another object is to provide a vacuum buffer system for accommodating paper webs of relatively large width and also paper webs of different widths.

Further objects and advantages of the present invention will become apparent as the following description proceeds and the features of novelty characterizing the invention will be pointed out with particularity in the claims annexed to and forming a part of this specification.

Briefly, the present invention is concerned with a paper buffer system between a supply of paper web and a processor operating on the paper web. The buffer system comprises a vacuum chamber and vacuum pump creating a pressure differential across a portion of the paper web forcing the web into the vacuum chamber in the form of a loop having suitable tension. The loop rises and falls within the vacuum chamber to either store web or deliver more web to the processor in response to the paper supply delivering more or less web than the processor can accommodate. In one embodiment, the vacuum chamber is provided with a movable wall to accommodate paper webs of different widths and a foot extending from the movable wall communicates with orifices to change the pressure differential.

BRIEF DESCRIPTION OF THE DRAWINGS

Other objects and advantages of the present invention will become apparent upon reading the following detailed description and upon reference to the drawings, in which:

Referring now to FIG. 1, there is illustrated a prior art printing operation having a supply reel shown at 10 supporting a paper web 12, a printing press 14, intermediate web guide apparatus 16, a nip roller 18 and in-feed roller 20, and a web tensioning mechanism 22. The web tensioning mechanism 22 generally isolates the printing press from the supply reel 10, and comprises a dancer arm 23, dancer arm pivot 24, a roller diaphragm actuator 26, and a dancer roll 28 mechanically connected by dancer arm 23 to dancer arm pivot 24. The dancer roll 28 is air loaded through the rolling diaphragm actuator 26 to maintain a constant level web tension and pivots about arm pivot 24 to move generally vertically as shown by the arrows in FIG. 1.

Figure 1:
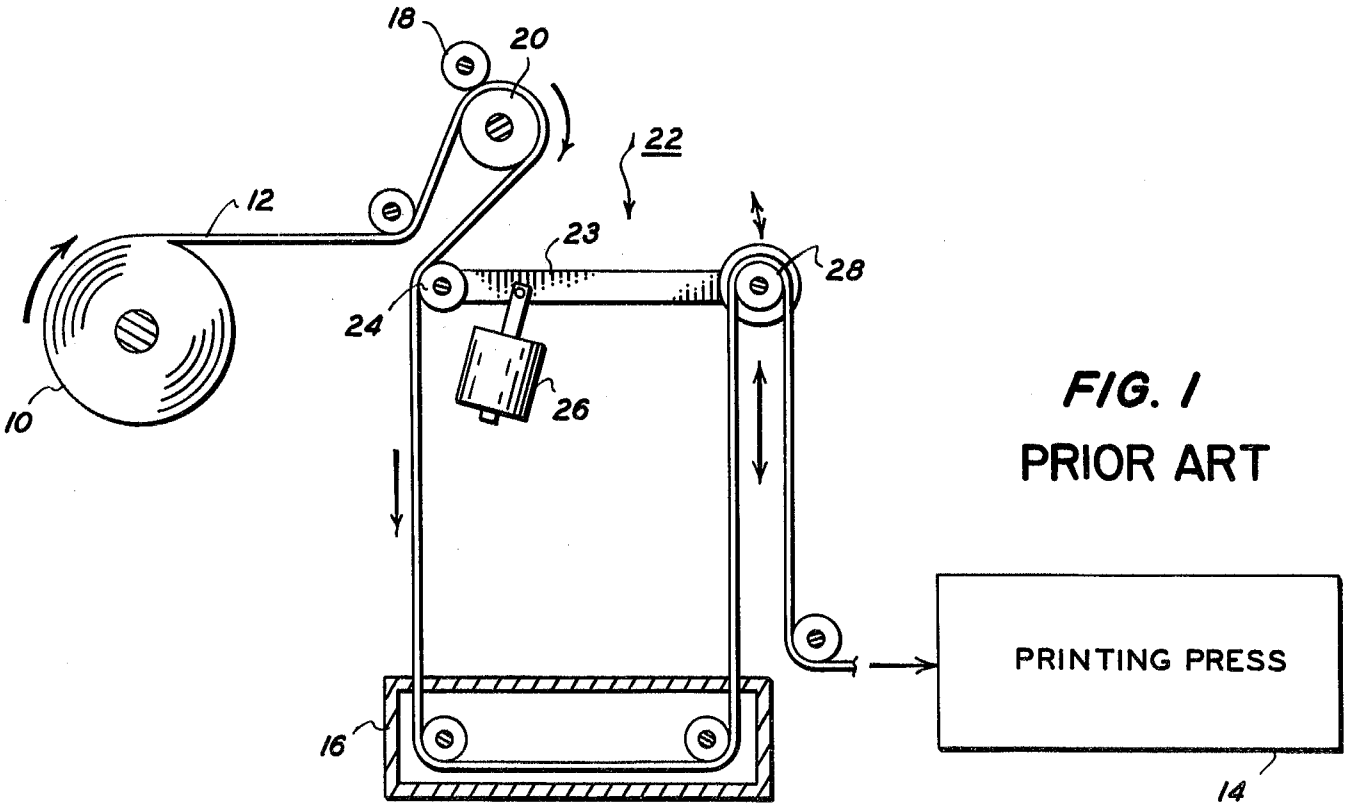
FIG. 1 PRIOR ART
FIG. 1 is a schematic view of a prior art printing operation having a dancer roll for proper web tensioning.

In operation the web 12 is between the in-feed roller 20 and the nip roller 18 and if the in-feed roller 20 is feeding more web 12 than the printing press 14 can accommodate, the dancer roll 28 rises vertically to store the excess web. If the infeed roller 20 is feeding less web 12 than the printing press 14 is accommodating, the dancer roll 28 moves downward vertically to deliver stored web to the press 14. There are other suitable mechanical dancer roll configurations in the prior art such as moving the dancer roll vertically independent of a pivot arm or having the paper web engaged by two dancer rolls pivoted about a common point.

Figure 2:
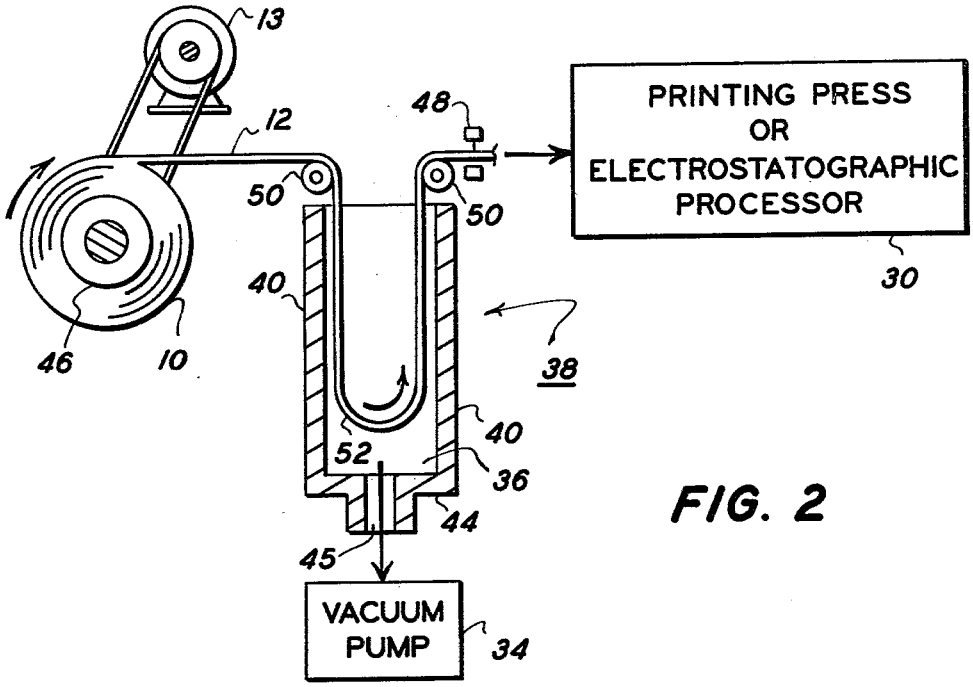
FIG. 2 is a side view of the web tensioning device in accord with the present invention.

In accord with the present invention, the mechanical dancer roll 28 and related mechanical inter-connections are replaced by a negative pressure system. With reference to FIG. 2, there is shown a simple paper web processing system comprising a supply reel 10 supporting a paper web 12, a processor 30 such as a printing press or electrophotographic or electrostatographic printing machine, a negative pressure system having a pressure reducing source or vacuum pump 34 and sub-atmospheric or vacuum chamber 36 providing suitable tensioning and buffering of web 12 and a motor or other driving force 13 suitably linked to reel 10 to convey paper web 12 to processor 30. Other components may be required such as web guides and infeed rollers but these form no part of the present invention.

Figure 3:
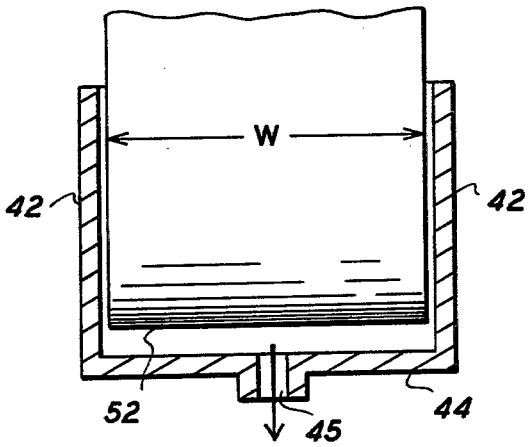
FIG. 3 is a front view of the web tensioning device of FIG. 2.

The sub-atmospheric or vacuum chamber 36 generally comprises a housing 38 having a first pair of parallel, oppositely disposed side walls 40 spaced a suitable distance to confine the loop of the paper web 12. A second pair of parallel, oppositely disposed side walls 42 as seen in FIG. 3 are spaced a sufficient distance to accommodate the width w of the paper web 12. The side walls 40 and 42 generally define a rectangular frame closed at one end by a lower frame cross member 44 secured to each of the side walls 40 and 42. The cross member 44 is provided with a suitable opening or port 45 communicating with the vacuum pump 34, providing continuous negative pressure within the vacuum chamber 36. It is understood that one skilled in the art can determine suitable tolerances between the paper web 12 and side walls 40 and 42 and provide a vacuum source sufficient to place the paper web 12 under suitable tension in the vacuum chamber 36. The paper web tension is generally a function of the size of the cross sectional area of the web and the negative pressure. Intermediate rolls 50 support a portion of the web 12 in communication with the open end of vacuum chamber 36. The system of FIG. 2 also includes high torque brake 46 and web brake detector 48 responsive to web breaks to initiate activation of brake 46. The high torque brake 46 is suitably adjusted to stop reels of different sizes and to provide controlled web tension during stops.

Figure 4:
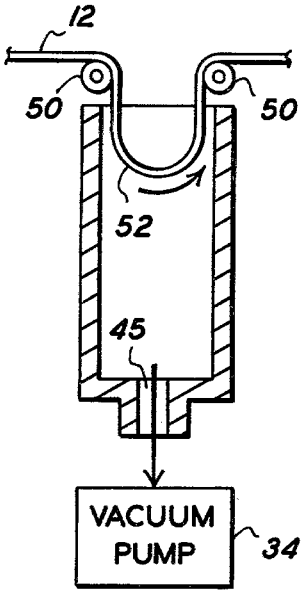
FIG. 4 is another view of the web tensioning device of FIG. 2 with minimum stored web.

The vacuum pump 34 is energized to draw the excess portion of web 12 into the vacuum chamber 36. In particular, evacuation of the vacuum chamber 36 creates a pressure differential across the segment of the web 12 adjacent the chamber between intermediate rolls 50 forcing the web into the chamber to form web loop 52 and tension the web about rolls 50. Excess web is drawn into the vacuum chamber until the web is suitably tensioned about rolls 50. In operation, if the reel 10 is feeding more web than can be accommodated by the processor 30, the pressure differential will force the loop 52 of the paper web 12 toward the bottom or lower end of the vacuum chamber 36 as best seen in FIG. 2 to take up the slack of the web from the supply reel 10. If the reel 10 is feeding less web than the processor 30 is accommodating, the loop 52 will rise toward the top of the vacuum chamber 36, as best seen in FIG. 4. The rise of loop 52 supplies sufficient web to the processor 30 and the pressure differential maintains suitable tension on the web. In effect, the vacuum chamber 36 provides a buffer to isolate the mass of the paper web 12 from the processor 30. The vacuum pump 34 and vacuum chamber 36 provide a relatively constant, uniform tension on web 12 and deliver or store web in response to variations in the processor operation.

Figure 5:
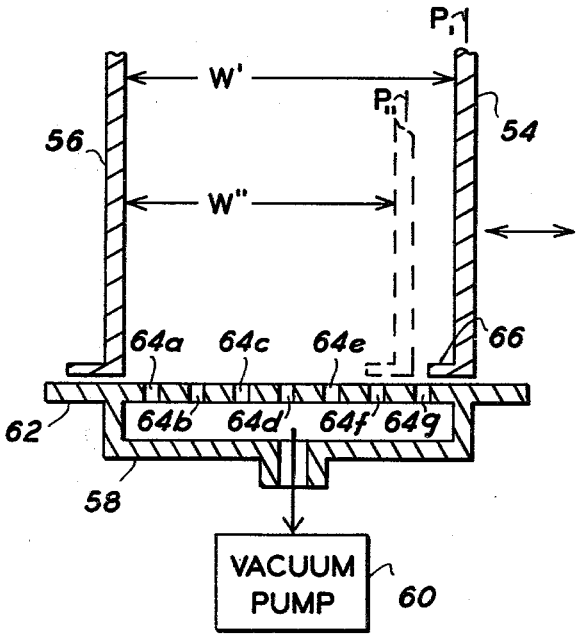
FIG. 5 is a modification of the web tensioning device as shown in FIG. 3.

In accord with the present invention, a modification of the vacuum chamber 36 is shown in FIG. 5. Two parallel and oppositely disposed walls 54, 56 define the width of the paper web in the vacuum chamber. Wall 54 is movable toward and away from stationary wall 56 by any suitable propelling mechanism to adjust for paper webs of different width. For example, in position $P_1$ the walls 54, 56 accommodate a paper web width $W^1$. To accommodate a paper web width of $W^{11}$, wall 54 is moved to position $P_{11}$ as shown in phantom.

The vacuum chamber is closed at one end by bottom member 58 connected to vacuum pump 60. Bottom member 58 includes a cross member or bottom wall 62 provided with a plurality of orifices 64*a*–64*g*. The movable wall 54 is disposed perpendicular to bottom wall 62 and slidingly engages bottom wall 62 and predetermined orifices 64*a*–64*g*, in moving from position $P_1$ to position $P_{11}$. In particular, in position $P_1$, all orifices 64*a*–64*g* communicate with the vacuum chamber. However, in position $P_{11}$, wall 54 defines the vacuum chamber exclusive of orifice 64*g*. The movement of wall 54 from position $P_1$ to position $P_{11}$, therefore, not only alters the size of the vacuum chamber but also reduces the negative pressure in the vacuum chamber by preventing communication of orifice 64*g* with the vacuum chamber. Alternatively, the negative pressure in the vacuum chamber is altered by a foot 66 extending perpendicular from movable wall 54 and disposed parallel and adjacent to bottom wall 62 slidingly engaging predetermined orifices 64*a*–64*g*. In position $P_1$, orifice 64*f* communicates with the vacuum chamber whereas in position $P_{11}$, foot 66 as shown in phantom blocks orifice 64*f* from communication with the vacuum chamber.

While there has been illustrated and described what is at present considered to be a preferred embodiment of the present invention, it will be appreciated that numerous changes and modifications are likely to occur to those skilled in the art and it is intended in the appended claims to cover all those changes and modifications which fall within the the true spirit and scope of the present invention.

What we claim as new and desire to be secured by Letters Patent of the United States is:

1. Paper handling apparatus comprising
   - a reel,
   - a supply of paper web supported by the reel,
   - a processor for operating on the paper web,
   - a motor operable to drive the reel to move the paper web from the reel to the processor,
   - intermediate rollers supporting the paper between the reel and the processor, and
   - a paper web buffer system, the buffer system comprising
   - a housing defining a vacuum chamber, one of the walls of the housing being a cross member in communication with the pressure reducing source, the cross member being provided with a plurality of orifices,
   - a pressure reducing source and
   - a portion of the paper web being disposed adjacent the vacuum chamber, the vacuum chamber and pressure reducing source being operable to create a pressure differential across said portion of the paper web and to draw said portion into a loop in the chamber, the housing being provided with a movable wall disposed generally perpendicular to the cross member and slidingly engaging predetermined orifices, the movable wall changing the number of orifices communicating with the vacuum chamber in moving from a first position to a second position to proportionately change the pressure in the vacuum chamber.

2. Paper handling apparatus comprising a reel, a supply of paper web supported by the reel, a processor for operating on the paper web, a motor operable to drive the reel to move the paper web from the reel to the processor, intermediate rollers supporting the paper between the reel and the processor, and a paper web buffer system, the buffer system comprising a housing defining a vacuum chamber, one of the walls of the housing being a cross member in communication with the pressure reducing source, the cross member being provided with a plurality of orifices, a pressure reducing source and a portion of the paper web being disposed adjacent the vacuum chamber, the vacuum chamber and pressure reducing source being operable to create a pressure differential across said portion of the paper web and to draw said portion into a loop in the chamber, the housing being provided with a movable wall slidingly engaging the cross member, the movable wall being provided with a foot, the foot extending parallel to the cross member and blocking predetermined orifices upon movement of the wall from a first to a second position.

* * * * *